United States Patent [19]

Starp

[11] 4,327,846

[45] May 4, 1982

[54] APPARATUS FOR SUPPLYING COOLING AND/OR POLISHING LIQUIDS, MORE ESPECIALLY FOR USE IN MACHINES FOR GRINDING AND/OR POLISHING OPTICAL LENSES

[75] Inventor: Franz Starp, Wildbad, Fed. Rep. of Germany

[73] Assignee: Prontor-Werk Alfred Gauthier GmbH, Calmbach, Fed. Rep. of Germany

[21] Appl. No.: 23,226

[22] Filed: Mar. 23, 1979

[30] Foreign Application Priority Data

Mar. 25, 1978 [DE] Fed. Rep. of Germany ..... 2813091

[51] Int. Cl.[3] ..... B67D 5/40

[52] U.S. Cl. ..... 222/382; 222/385; 222/146 C; 220/335

[58] Field of Search ..... 222/383, 385, 382, 333, 222/146 C, 372; 220/335; 248/311.1 R; 51/266, 267

[56] References Cited

U.S. PATENT DOCUMENTS

| | | | |
|---|---|---|---|
| 1,605,758 | 11/1926 | Moussette | 222/382 |
| 2,835,416 | 5/1958 | Steele | 222/382 X |
| 3,190,507 | 6/1965 | MacMillin | 222/383 |
| 3,227,326 | 1/1966 | Beamer | 222/382 X |
| 4,148,411 | 4/1979 | Hodge | 220/335 X |

*Primary Examiner*—Allen N. Knowles
*Attorney, Agent, or Firm*—Arthur A. March

[57] ABSTRACT

An apparatus for supplying polishing and/or cooling liquid, including a storage container preferably removably supported on a supporting frame, a downwardly facing dished cover for the container pivotally mounted on the frame by a hinge joint assembly and having a bent-over edge whose outer peripheral dimension is slightly smaller than the corresponding inside peripheral dimension of the upper edge of the container to provide a clearance gap therebetween, with the cover supporting thereon various elements such as a discharge pipe and a pump assembly for conveying liquid from the container as well as a mechanism for varying the temperature of the liquid, and stops on the cover and hinge joint assembly, respectively, for determining the range of movement of the cover between closed and open positions relative to the container.

15 Claims, 3 Drawing Figures

Fig. 1
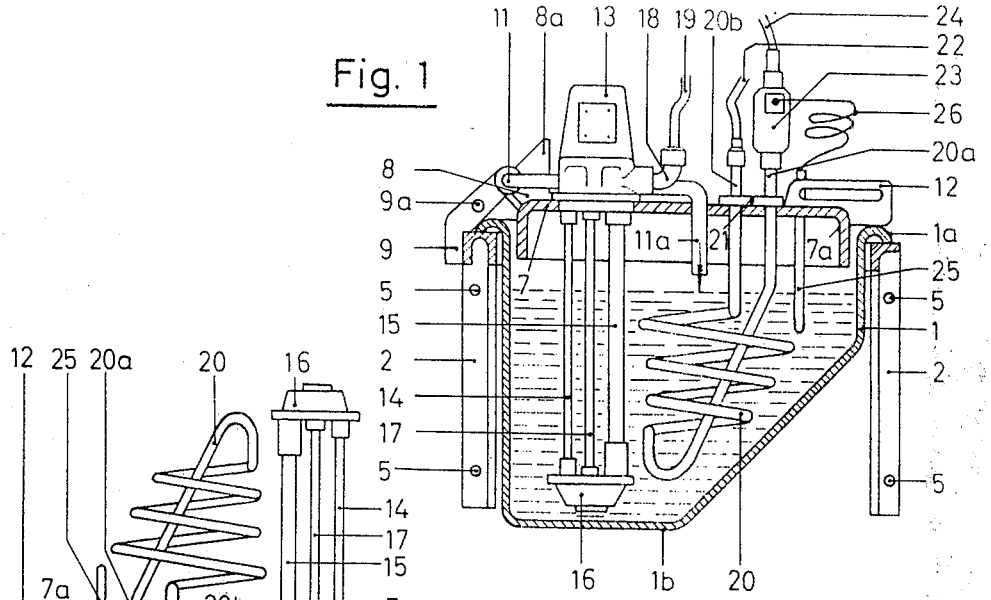
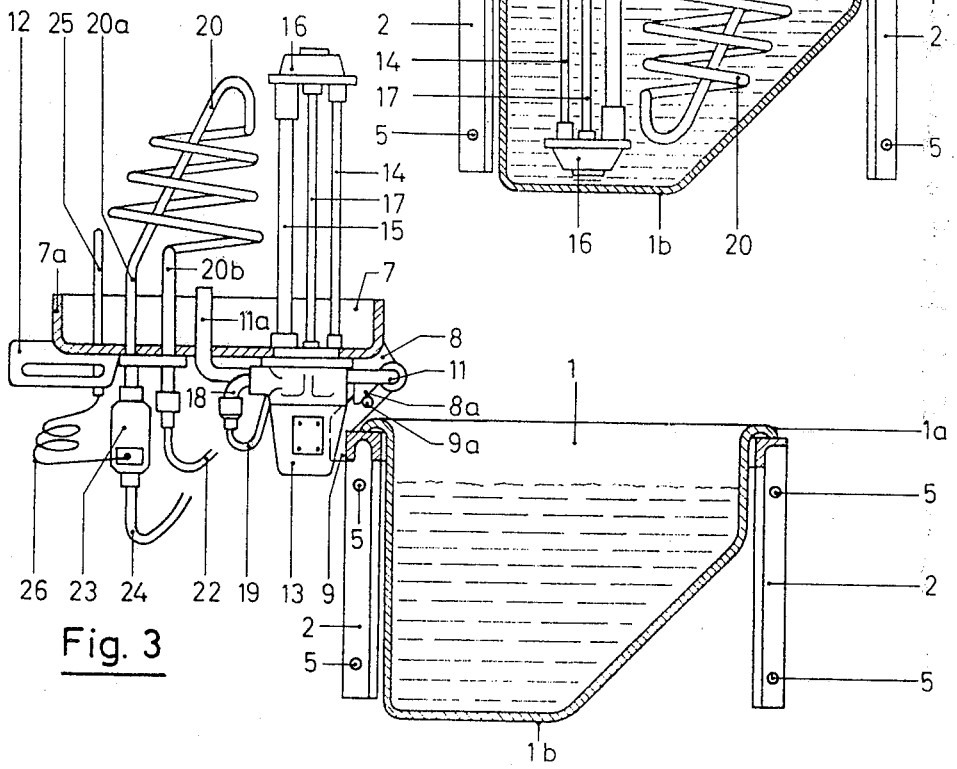
Fig. 3
Fig. 2
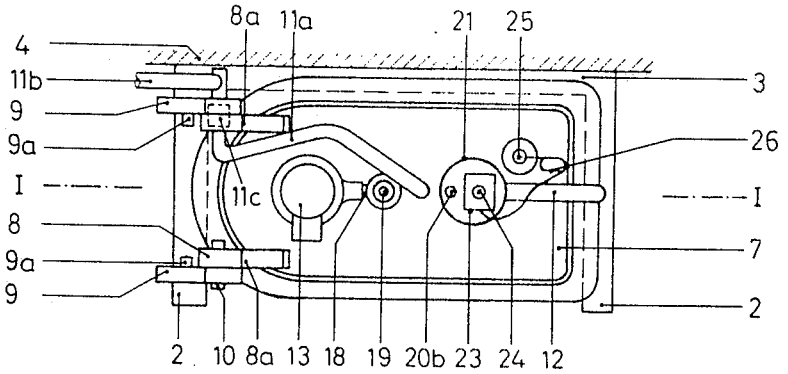

APPARATUS FOR SUPPLYING COOLING AND/OR POLISHING LIQUIDS, MORE ESPECIALLY FOR USE IN MACHINES FOR GRINDING AND/OR POLISHING OPTICAL LENSES

The present invention relates to an apparatus for supplying cooling and/or polishing liquids, more especially for use in machines for grinding and/or polishing optical lenses. The apparatus is of the type preferably comprising a supporting frame, generally located at the side of the machine or mounted thereon, a storage container removably inserted in the supporting frame, and a cup-shaped or pot-shaped cover for the container which carries thereon a discharge pipe for the liquid and a device for conveying the liquid from the container through the discharge pipe, such as for conducting the liquid to a processing station, for example located between a tool and workpiece.

An analogous apparatus is substantially known from German Patent 509,302, but in that case the conveying of the liquid stored in the container is effected by compressed air which is introduced into the container. The container cover is so formed that its bent over edge outwardly overlaps the edge of the container or more specifically the container aperture. This means, however, that on removal of the cover, say for topping up, or similar procedure, the liquid sprayed over the inside surface of the cover, e.g. under the effects of the compressed air environment, does not necessarily return into the container, but can drip into the surrounding area and dirty it.

It is among the objects and advantages of the present invention to improve existing apparatus of the type in question and to insure that any liquid sprayed onto the inside surface of the container, even when the cover is open, always drips back into the container.

Other and further objects and advantages of the present invention will become apparent from a study of the within specification and accompanying drawing, in which:

FIG. 1 is a schematic sectional view taken on the line I—I of FIG. 2 of an apparatus according to an embodiment of the invention for supplying cooling and/or polishing liquid;

FIG. 2 is a schematic plan view of the apparatus of FIG. 1; and

FIG. 3 is a similar view to that of FIG. 1, but with the container cover hinged open.

According to the present invention, an apparatus is provided for supplying cooling and/or polishing liquid, more especially for use in machines for grinding and/or polishing optical lenses, comprising preferably a supporting frame locatable at the side of a machine with which it is to be used, a storage container removably insertable in the supporting frame, and a pot-shaped or cup-shaped cover for the container.

The cover preferably supports a discharge pipe for the liquid and a device for conveying the liquid from the storage container through the discharge pipe to a processing station. More specifically, the cover is advantageously pivotally mounted on the supporting frame by means of hinge joints, and the outer peripheral or circumferential perimetric dimensions of the edge of the cover are smaller than the corresponding inside peripheral or circumferential perimetric dimensions of the storage container.

Stops are suitably provided at the side edge regions of the cover which limit the pivotal angle of the cover with regard to its position closing the container and its opposite open position.

In this manner the operator, for example for the purpose of carrying out maintenance work, is able to open the cover on the storage container further outwardly than heretofore. However, the cover cannot be completely removed since it is hingedly pivoted to the supporting frame, and during opening the smaller dimensioned cover edge is either located within the range of the container aperture, so that liquid dripping from the cover returns directly into the container, or as it is further pivoted towards completely open position faces upwards so that the cover underside acts as an upwardly directed collecting dish and hence also prevents any spray liquid deposited thereon from dripping into the surrounding area.

The hinge-like mounting of the cover on the supporting frame moreover permits the apparatus to be handled in an effort saving manner, since the weight of the structural unit comprised of the cover and other fittings supported thereby during its pivoting to open position is transmitted first only partially, but then progressively, to the hinges.

A preferred further development of the invention is that a stop on the cover for fixing or determining the closure position is adapted as or forms a handle supported against the edge of the storage container in the closure position.

In order to insure the relative mobility of portions of the pipeline for returning the polishing and cooling liquid back to the container, which is provided in part on the cover and in part on the machine frame or supporting frame, provision is made in accordance with the invention for the pipeline portion on the cover to be passed through at least one of the hinge joints and connected via a rotary coupling with the pipeline portion laid on the side of the frame. A structurally simple and functionally technically favorable installation of the pipeline may be additionally attained in that the portion of the pipeline on the cover may also be used for the axle of at least one of the hinge joints.

In the drawing, a storage container 1 for polishing or cooling liquid is shown which is received by a supporting or machine frame 2 and 3. The supporting frame 2, 3 may be made of section iron, preferably conventional angle iron or the like, and for the purpose of enabling insertion and removal of the container 1 from the supporting frame 2, 3 to be carried out readily, e.g. slidably, it may be open at one side such as shown in FIG. 2, while being secured on the other side to a housing 4, partly indicated schematically in this view, of a machine for polishing lenses or the like as by means of screws 5. The container 1 is outwardly flanged over at its upper edge 1*a* and abuts against the horizontal top surface of the angle iron portion 2 of the supporting frame 2, 3. Its bottom end 1*b* may be shaped as a collection sump.

A cover 7 having a downwardly bent over edge region 7*a*, or cup-shaped or dished cover, is provided as a hinged cover for the container 1 and is connected to the horizontally extending parts of the supporting frame 2, 3 by means of stationarily arranged and pivotally coacting hinge joints 8 and 9. In the embodiment shown, one of the hinge joints 8, 9 is connected by a bolt 10 (FIG. 2) and the other by a portion of a pipeline 11 (FIG. 1) for the re-supply of the polishing or cooling liquid to the container. Thus, the hinge joint 8, 9 as pivot mounting means stationarily pivotally mount the cover 7 on the frame 2, 3 for pivotal movement of the cover along a fixed path, i.e. about a stationary pivot axis through the hinges and thus stationarily arranged on the frame, between a closure position in relation to the container 1 (FIG. 1) and a correspondingly opposite open position remote from the container opening (FIG. 2).

On the side opposite the hinges 8, 9, forming the hinge joint assembly, the cover 7 is supported by means of a stop 12 secured thereto and formed as a handle, which is evident especially from FIG. 1. Additionally, various appropriate units, fittings and conduits for conveying and varying the temperature of the polishing and cooling liquid are firmly but detachably secured to the cover 7.

Thus, an electric motor 13 is provided on the cover 7 to which, by means of a retaining rod 14 projecting into the interior of the container 1 and a riser pipe 15, a feed pump 16 is secured. The feed pump 16 is driven via a drive shaft 17 which is located between retaining rod 14 and riser pipe 15. The riser pipe 15 in turn communicates by means of a passage formed in the housing of the electric motor 13, and not further shown, with an elbow 18 which is connected to a flexible supply pipe 19 leading into the processing station of the processing machine (not shown).

The polishing or cooling liquid supplied to the processing station is returned via the rigid pipeline 11 firmly installed on the machine, and the cover 7 is preferably provided with a fall or incline from the machine towards the storage container 1 to take advantage of the effects of gravity, the cross-sectional flow area of the pipeline being selected to be sufficiently relatively large to insure a satisfactory return flow of liquid polishing agent from the processing station to the container 1.

Since the portion 11*a* of the pipeline 11 installed on the cover 7 understandably has to be displaceable relative to the pipeline portion 11*b* fixedly mounted on the machine frame, the displaceable portion or section 11*a* is favorably connected by means of a rotary coupling 11*c* to the fixed portion or section 11*b*, and furthermore, is passed through one of the two hinges 8, 9 and in this way extends coaxially to the hinge bolt 10 (see FIG. 2).

In accordance with the closure position of the cover 7 shown in FIG. 1, the cover 7 also positionally locates the storage container 1 relative thereto, whereupon all the contemplated units, such as the feed pump 16, a cooling coil 20 and a thermal sensor 25, are immersed in the polishing or cooling liquid contained in the container 1. If, on the other hand, the cover 7 is hinged or pivoted to open position, say for topping up or stirring the liquid, from the covered position, then it is supported as shown in FIG. 3 by a stop formed by a radial projection 8*a* and a pin 9*a* remote from the container opening.

In a different manner from that shown in the drawings, the supporting frame 2, 3 may also be adapted as an independent structural unit detached from the machine body and displaceable relative thereto, as the artisan will appreciate. Such an arrangement, fitted for this purpose with rollers or casters, enables the supporting frame including the storage container to be inserted, for instance, in a space-saving fashion, into open spaces provided in the machine frame.

It will be realized that in conventional manner thermal sensor 25 is connected via feedback line 26 operatively to the flow control 23 for controlling the coolant flow through flexible supply line 24, inlet 20*a* and outlet 20*b* of coil 20, and flexible exhaust line 22. Retaining plate 21 suitably mounts coil 20 on the cover 7 via inlet 20*a* and outlet 20*b*.

Desirably, the various controls and sensors for the units fixed to and through the cover 7 are arranged to cease to operate when the cover is pivoted to open position. Since these parts are sealed at their connections to the cover, no leakage thereat will occur when the units are in inverted disposition as shown in FIG. 3. Instead, any liquid clinging thereto or deposited on the concave underside or inside of the dished cover will remain therein as the latter is pivoted to face upwardly. The downwardly depending edge portion 7*a* will form a suitable retaining wall for collecting all such liquid.

Advantageously, by fashioning the radial projections 8*a* and pins 9*a* on the hinge joints 8, 9 at substantially 180° apart when the cover 7 is closed, yet along a line or plane at an angle of substantially 45° to the horizontal and to the cover in either position, upon movement of the cover to open position proper inverted orientation of the depending edge 7*a* of the cover will be insured to prevent liquid loss through drainage or dripping thereat while permitting simple and compact arrangement of the radial projections 8*a* and pins 9*a* in an axially offset location so as to avoid both interference with intermediate range hinge part movement between the ultimate closure and open positions and interference with access to the vicinal parts.

It will be seen that since the various components on the cover 7 extend bilaterally therefrom, they will favorably provide more or less counterbalancing transverse elements, such that as the cover is raised to open position by grasping the handle portion of stop 12, the heavy motor 13 and control 23 will increasingly act as counterweights about the hinge joints 8, 9 offsetting the deadweight of the pump 16 and coil 20 until the verticalequilibrium point in the pivotal arc is reached, whereupon the latter elements will act as counterweights to the former. The same counterbalancing effect will likewise be achieved upon raising the cover in opposite direction to move the same back from open to closure position.

Naturally, the pivot axis should extend within the area of the upper opening defined by the upper inside peripheral edge 1*a* or be at most substantially coincident with the vertical plane of the inside wall of the container 1 thereat in order that in any position of limited pivotal movement of the cover 7, i.e. between the cover stop 12 and the support and hinge part stops constituted in each instance by radial projection 8*a* and axially offset pin 9*a*, the depending edge 7*a* of the cover will in turn either continuously overlie the container opening to prevent dripping beyond the vertical confines of the container edge 1*a*, or be sufficiently inverted or upwardly inclined to self-contain any such dripping in the upwardly facing underside retaining well thereby provided therein.

On the other hand, if the pivot axis were positioned outside of the vertical confines of the container opening, the depending cover edge 7*a* in moving along the initial 90° arc from closure position upwardly would not reach its self-containing position until after it had traveled outwardly beyond the vertical confines of such container opening whereby interim spillage and dripping would undesirably occur outside of the container.

It will be seen that the container, depending cover edge and units extending downwardly through the cover are concordantly selectively sized and shaped to permit clearance between the container, on the one hand, and the cover and such units, on the other hand, throughout the limited pivotal movement of the latter, as well as a clearance gap between container upper edge and the cover depending edge in the closure position of the cover. Thus, the container is arranged relative to the cover to provide inherently open communication between the container interior and the container exterior through the clearance gap when the cover is in the closure position.

Accordingly, the present invention advantageously provides an apparatus comprising a storage container for supplying liquid and having an upper inside peripheral edge portion defining an upper opening or aperture of selective perimetric dimension, a generally conforming or complementally shaped cover for covering the container opening and having a more or less outwardly and downwardly confining or depending outside peripheral edge portion or retaining flange of sufficiently smaller corresponding dimension than that of the container opening to provide a clearance gap therebetween, and mounting means arranged for mounting the cover for movement between a closure position in covering relation across the container opening inwardly of the gap and an open position remote from the opening to permit access to its interior.

Hence, the cover, which may support thereon means for conveying liquid from the container and which extend downwardly from the cover and into the container interior when the cover is in covering relation thereat, upon opening movement and upon in turn reaching its minimum critical inverted orientation angle, will effectively self-contain within the inverted confines threof any adhering or deposited liquid thereon or on the means for conveying liquid. Any such liquid will favorably drain or drip downwardly back through the container opening and into the container interior prior to the cover reaching its inverted orientation or more specifically such minimum critical inverted orientation angle, i.e. at which point the interior or underside margin or edge portion of the cover will be upwardly inclined rather than downwardly inclined and thereby self-contain any remaining liquid thereon.

The stop means for limiting the range of movement of the cover between the closure and open positions favorably include, in accordance with the foregoing, a cover stop extending peripherally outwardly from the cover sufficiently for spanning the clearance gap and for contact with the container edge portion for limiting the movement of the cover upon reaching the closure position, and preferably having or forming a handle portion for manually opening or raising the cover, as well as a support stop on a support which is adjacent the container and which constitutes a part of the mounting means, such as a frame support at the side of the container and stationarily or fixedly disposed relative to the movable cover, for correspondingly limiting the movement of the cover upon reaching open position.

Besides the support, the mounting means suitably also constitutes hinge joint means pivotally interconnecting the cover and support, which in particular may include a support hinge part connected to the support and having the support stop thereon and a cover hinge part connected to the cover and having a radial projection for contact with the support stop for limiting such movement of the cover upon reaching the open position, as aforesaid.

Because the apparatus normally contemplates liquid pipeline means for returning or supplying liquid to the container, the same may be desirably provided, in regard to a specific feature of the invention, as a two part flow path construction, including a support pipeline part fixed on the support and a cover pipeline part fixed on the cover and arranged for flow communication, e.g. in the form of an open end discharge outlet, with the container through the container opening and furthermore having a pipeline portion thereof passing through the hinge joint of the hinge joint means, with a rotary coupling coaxial to the hinge joint operatively interconnecting the pipeline parts for relative rotational movement about the hinge joint.

Not only will the above aspects of the invention prevent any spillage or dripping of liquid from the cover pipeline part beyond the vertical confines of the container opening but by appropriately fashioning the cover pipeline part, the pipeline portion thereof passing through the hinge joint may form or constitute the axle or hollow pin for the hinge joint as well.

Favorably, the hinge axis of the hinge joint is positioned more or less substantially coincident with a vertical plane passing through the upper inside peripheral edge portion of the container adjacent thereto whereby to assure that no spillage or dripping of liquid from the cover or from any components contained thereon will occur beyond the vertical perimetric confines of the container opening thereat in any position of movement of the cover relative to the container. In this regard, the radius from the pivot axis thereat to the opposing inside edge portion of the container opening remote therefrom will limit within its corresponding circumferential pivot arc confines the maximum dimensions and extent of the cover and the portions of the components carried thereon and projecting downwardly therefrom toward the interior of the container, whereby to preserve the clearance gap, permit unhindered pivoting of the cover and such components relative to the container, and at the same time define the zone of permitted spillage or dripping.

It will be appreciated that the foregoing specification and drawings are set forth by way of illustration and not limitation, and that various changes and modifications may be made therein without departing from the spirit and scope of the present invention, which is to be limited solely by the scope of the appended claims.

What is claimed is:

1. Apparatus for supplying cooling and/or polishing liquid to a processing station, such as for use in machines for grinding and/or polishing optical lenses, comprising a supporting frame adapted to be located at the side of a machine with which it is to be used, a storage container removably insertable in the frame and having a container opening, a cover for the container having side edge regions and a downwardly depending outer perimetric edge, and supporting thereon a discharge pipe for the liquid and a device for conveying the liquid from the container through the pipe for conducting the liquid to a processing station, stationarily arranged and pivotally coacting hinge joints stationarily pivotally mounting the cover on the frame, for pivotal movement of the cover along a fixed path about a stationary pivot axis stationarily arranged on the frame between a closure position in relation to the container and a correspondingly opposite open position remote from the container opening, the container having inside perimetric dimensions at the container opening and the outer edge of the cover having corresponding outer perimetric dimensions and the outer perimetric dimensions of the edge of the cover being smaller than the inside perimetric dimensions of the container to provide a clearance gap therebetween when the cover is at the closure position and to provide open communication between the container interior and the container exterior through such clearance gap when the cover is in the closure position, and individual spaced apart stops arranged at the side edge regions of the cover for limiting the pivotal angle of movement of the cover between the closure position in relation to the container and the correspondingly opposite open position remote from the container opening.

2. Apparatus according to claim 1 wherein a stop is arranged on the cover for determining the closure position and which forms a handle supported against the edge of the container in the closure position.

3. Apparatus for supplying cooling and/or polishing liquid to a processing station, such as for use in machines for grinding and/or polishing optical lenses, comprising a supporting frame adapted to be located at the side of a machine with which it is to be used, a storage container removably insertable in the frame, a cover for the container having side edge regions and a downwardly depending outer perimetric edge, and supporting thereon a discharge pipe for the liquid and a device for conveying the liquid from the container through the pipe for conducting the liquid to a processing station, hinge joints pivotally mounting the cover on the frame, the container having inside perimetric dimensions and the outer edge of the cover having corresponding outer perimetric dimensions and the outer perimetric dimensions of the edge of the cover being smaller than the inside perimetric dimensions of the container, and stops arranged at the side edge regions of the cover for limiting the pivotal angle of movement of the cover between a closure position in relation to the container and a correspondingly opposite open position, and wherein a pipeline is provided which is adapted for discharging liquid from the region of the processing station into the container, and which has a pipeline portion arranged on the cover and passing through at least one of the hinge joints, a pipeline portion arranged on the frame, and a rotary coupling interconnecting the pipeline portions.

4. Apparatus according to claim 3 wherein the pipeline portion passing through said at leastone of the hinge joints forms the corresponding hinge joint axle therefor.

5. Apparatus according to claim 1 wherein the cover is cup-shaped.

6. Apparatus comprising a storage container for supplying liquid and having an upper inside peripheral edge portion defining an upper opening of selective dimension therein, a conforming cover for covering the container opening and having a depending outside peripheral edge portion of sufficiently smaller corresponding dimension than that of the container opening to provide a clearance gap therebetween, and supporting thereon means for conveying liquid from the container which extend downwardly from the cover into the container when the cover is in covering relation thereat, and mounting means including stationarily arranged and pivotally coacting pivot means thereon arranged for stationarily pivotally mounting the cover on the mounting means for pivotal movement of the cover along a fixed path about a stationary pivotal axis stationarily arranged on the mounting means between a closure position in covering relation across the container opening inwardly of the clearance gap and in spaced relation to the container and an open position remote from the container opening, said container being arranged relative to the cover to provide open communication between the container interior and the container exterior through such clearance gap when the cover is in the closure position.

7. Apparatus according to claim 6 wherein stop means are provided for limiting the range of movement of the cover between the closure and open positions.

8. Apparatus according to claim 6 wherein the cover has a cover stop extending peripherally outwardly therefrom sufficiently for spanning the clearance gap and for contact with the container edge portion for limiting the movement of the cover upon reaching the closure position.

9. Apparatus according to claim 8 wherein the cover stop includes a handle portion for manually opening the cover.

10. Apparatus according to claim 6 wherein the mounting means includes a support adjacent the container and having a support stop for contact with the cover for limiting the movement of the cover upon reaching the open position.

11. Apparatus according to claim 6 wherein the mounting means includes a support and hinge joint means pivotally interconnecting the cover and support.

12. Apparatus comprising a storage container for supplying liquid and having an upper inside peripheral edge portion defining an upper opening of selective dimension therein, a conforming cover for covering the container opening and having a depending outside peripheral edge portion of sufficiently smaller corresponding dimension than that of the container opening to provide a clearance gap therebetween, and supporting thereon means for conveying liquid from the container which extend downwardly from the cover into the container when the cover is in covering relation thereat, and mounting means arranged for mounting the cover for movement between a closure position in covering relation across the container opening inwardly of the clearance gap and an open position remote from the container opening, and wherein the cover has a cover stop extending peripherally outwardly therefrom sufficiently for spanning the clearance gap and for contact with the container edge portion for limiting the movement of the cover upon reaching the closure position, the mounting means includes a support and hinge joint means pivotally interconnecting the cover and support, the hinge joint means includes a support hinge part connected to the support and a cover hinge part connected to the cover and having a radial projection, and the support has a support stop for contact with the radial projection for limiting the movement of the cover upon reaching the open position.

13. Apparatus according to claim 11 wherein the hinge joint means includes a hinge joint, and liquid pipeline means for the container are provided including a support pipeline part on the support, a cover pipeline part on the cover arranged for flow communication with the container through the container opening and having a pipeline portion thereof passing through the hinge joint, and a rotary coupling coaxial to the hinge joint and interconnecting the pipeline parts for relative rotational movement about the hinge joint.

14. Apparatus according to claim 13 wherein the pipeline portion passing through the hinge joint forms the axle for the hinge joint.

15. Apparatus according to claim 11 wherein the hinge joint means have a hinge axis positioned substantially coincident with a vertical plane passing through the upper inside peripheral edge portion of the container adjacent thereto to prevent spillage or dripping of liquid from the cover and from the means supported thereon beyond the vertical perimetric confines of the container opening in any position of movement of the cover relative to the container.

* * * * *